United States Patent [19]

O'Toole

[11] 4,185,260

[45] Jan. 22, 1980

[54] EXTERNALLY-PROGRAMABLE SWITCH

[76] Inventor: Lawrence P. O'Toole, 80 Steiner Ave., Neptune City, N.J. 07753

[21] Appl. No.: 921,848

[22] Filed: Jul. 3, 1978

Related U.S. Application Data

[63] Continuation-in-part of Ser. No. 724,511, Sep. 30, 1976, Pat. No. 4,101,857.

[51] Int. Cl.[2] ..... H01H 9/00

[52] U.S. Cl. ..... 335/206; 335/207

[58] Field of Search ..... 335/205, 206, 207

[56] References Cited

U.S. PATENT DOCUMENTS

| | | | |
|---|---|---|---|
| 3,441,691 | 4/1969 | Newman et al. | 335/206 X |
| 3,660,789 | 5/1972 | Weisenburger | 335/206 |
| 3,685,041 | 8/1972 | Kondur | 335/206 X |
| 3,719,887 | 3/1973 | Shimizu et al. | 335/206 X |
| 3,804,999 | 4/1974 | Hubbard | 335/206 X |

*Primary Examiner*—George Harris

*Attorney, Agent, or Firm*—Charles F. Gunderson

[57] ABSTRACT

A magnetically-actuated switch has a stationary mounting base to which a plurality of magnetically-actuated reed-type switches are secured in a layer parallel to the base. A moveable portion of the switch is pivotably mounted to the mounting base, and contains a plurality of magnets positioned to actuate the reed-type switches in any desired sequence. A second layer of magnetically-actuated, reed-type switches is positioned, parallel to the mounting base, below the above-mentioned layer, and additional magnets are added to the moveable portion, to supplement the existing magnets, and increases the magnetic field in certain portions of the moveable portion to effect the lower layer of reed-type switches.

7 Claims, 5 Drawing Figures

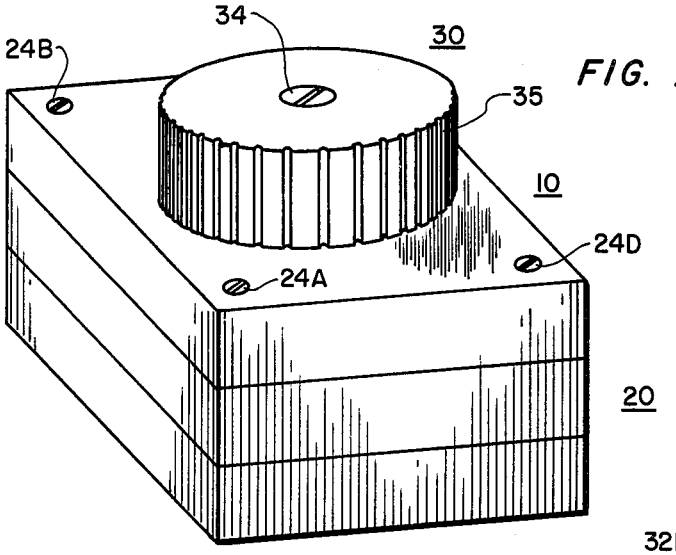
FIG. 1
FIG. 2
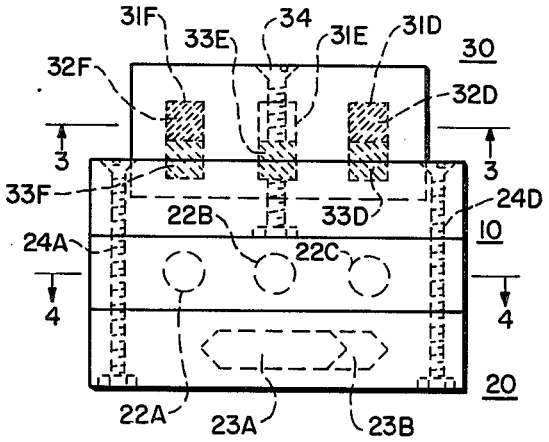
FIG. 3
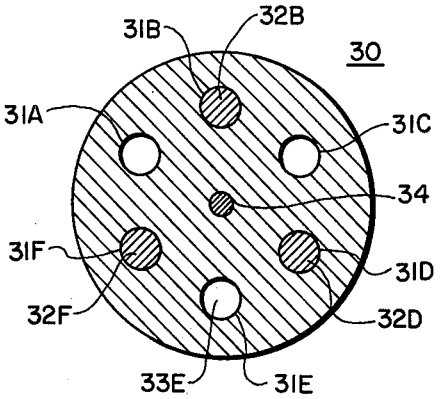
FIG. 5
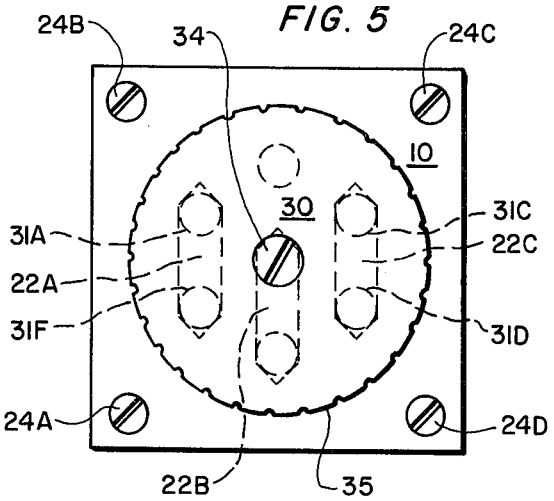
FIG. 4
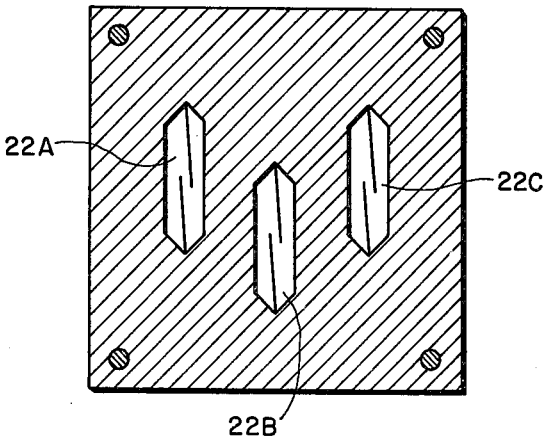

EXTERNALLY-PROGRAMABLE SWITCH

This application is a continuation-in-part of my copending patent application Ser. No. 724,511, for an "Externally Programable Switch", filed Sept. 30, 1976 now U.S. Pat. No. 4,101,857.

BACKGROUND OF THE INVENTION

Magnetically actuated, reed-type switches are fairly-well known, and are quite reliable in the present state of the art. They are particularly valuable and useful in situations where electrical contacts are necessary, but the inevitable arcing of the electrical switching would be hazardous. Not only would the arcing be hazardous in combustible atmospheres, but the atmosphere itself may be damaging to the switch contacts. The oxygen in the air oxidizes the contacts; the caustic vapors in the air corrode the contacts; and the dust in the air causes malfunction of the contacts.

However, most of the reed-type switches and their magnetic controls are single units, designed for specific installations or functions, and may or may not be adaptable to other uses.

A possible exception is seen in the Rotary Reed Switch of Weisenburger, U.S. Pat. No. 3,660,789, issued May 2, 1972. Here the switches have a cylindrical configuration to provide a comparatively compact device. The magnet is mounted on a central rotor to actuate the switches in turn as it is rotated. However, there is no flexibility of control taught or suggested here. There is only one layer of reed switches shown or within the scope of this device, and only one magnetic function. This inherently limits the switch to a simple rotary switching function that in no way anticipates the dual, complex and variable switching functions that are possible with the subject device.

Compound switches are also very well known and have many types including the common rotary switches that can have a plurality of peripheral contacts to be actuated in a variety of ways, in continuous or reciprocal motions, to provide an almost infinite variation of switching functions. Each layer of rotary switches can provide several functions and many layers of switches can be used to provide various additional combinations of functions.

However, almost all of the rotary switches must have fixed contacts, and once a given switching sequence is set up on any one of the layers of switches, it cannot be changed without rebuilding or rewiring the switch. In any case almost all of the conventional, rotary switches would have the inevitable arcing problems that would preclude their use in certain areas, as well as the susceptibility to oxidation, corrosion and malfunction, as noted earlier. Lastly, almost all of these compound switches may be limited in the amount of current and voltage that they can carry without permanent damage.

It is therefore an object of this invention to provide a rotary switch with reed-type switching elements that can control relatively high currents and voltages without any potential hazard due to arcing or damage to the contacts due to atmospheric conditions.

It is a further object of this invention to provide a compound rotary switch that can be set up to provide a series of complex switching functions, for any desired purpose, wherein both the combinations of switches and the combinations of the magnetic actuators of the switches can be varied at will to perform other complex switching functions, by very simple mechanical changes, without having to change any electrical contacts.

SUMMARY OF THE INVENTION

A rotary switch has a rotary, moveable portion pivotably attached to a mounting base. The rotary portion has a series of holes or slots positioned at given intervals around the rotary portion; each of the slots formed to accommodate a given magnet or combination of magnets. These magnets, or combinations of magnets, are designed to actuate one or more magnetically-actuated, reed-type switches that are positioned in one or more layers under the mounting base. The arrangement of the reed-type switches may be varied in any layer to cooperate with the pattern of magnets in the rotary portion to provide any desired switching function. The layers and combinations of switches within the layers may be varied at will, along with the orientation and combination of the magnets, to change the switching functions of the basic switch.

BRIEF DESCRIPTION OF THE DRAWINGS

FIG. 1 shows an isometric view of a preferred embodiment of the invention;

FIG. 2 shows a vertical cross section of the species of FIG. 1;

FIG. 3 shows a horizontal cross section of one portion of FIG. 2;

FIG. 4 shows a horizontal cross section of another portion of FIG. 2; and FIG. 5 shows a top view of the species of FIG. 1.

DESCRIPTION OF THE PREFERRED EMBODIMENT

Referring now more particularly to FIG. 1 an isometric view of the device is shown with a mounting base 10, a stationary portion 20, and a rotary, moveable portion 30. The mounting base is seen to have bolts 24A–D to secure the stationary portion 20 to the mounting base. The rotary, moveable portion may have a pivot bolt 34, and, since the rotary portion may be manually controlled, it may be knurled, as at 35, to facilitate manual control.

FIG. 2 is a side view of the species of FIG. 1, wherein the same elements—as in all of the figures—have the same numbers. In FIG. 2, certain of the inner elements are shown in dotted lines to show their positioning and the relationship of the elements. FIG. 2 shows, for example, that the mounting base 10 may be recessed to accommodate the rotary, moveable portion 30, whose pivot bolt 34 is seen to hold the two portions in a pivotable relationship. This figure also shows some of the holes or slots 31A–F that may contain upper magnets 32A–F and lower magnets 33A–F whose magnetic fields will penetrate the mounting base 10 and the stationary portion 20 to actuate the reed-type switching elements in the stationary portion. Some of these magnets will be seen in a typical positioning in the cross section of FIG. 3 to be described later.

The stationary portion 20 is seen to be secured to the mounting base 10 by the mounting bolts, such as 24A and 24D. The stationary portion is seen to include an upper layer with reed-type switches 22A–C and a lower portion with reed-type switches 23A and 23B visible from this angle. These reed-type switches will be more clearly seen in the cross section of FIG. 4 to be described later.

FIG. 3 shows a horizontal cross section of the rotary, moveable portion of the device of FIGS. 1 and 2, along the lines 3—3 of FIG. 2. This is a cross section of the upper part and its magnets, and shows that only certain of the holes or slots 31A–F may include magnets, such as 32B, 32D, and 32F. The lower part of the rotary, moveable portion may have magnets 33B, not shown, as well as 33D, 33E, and 33F. Certain of the holes or slots, such as 31A and 31C, must have no magnets, or must have magnetic polarities reversed, or there could be no switching function in one or both of the layers.

FIG. 4 shows a horizontal cross section of the upper layer of the typical reed-type switches 22A, 22B, and 22C. This layer is seen to be positioned 90 degrees around from the lower layer although they could also be superimposed. The orientation of the reed-type switches and the possible variations will be discussed in the operation of this device.

FIG. 5 shows a top view of the overall device of FIG. 1, with dotted lines, as in FIG. 2, again showing the general layout of the magnets and of certain of the switching elements. The knurled portion 35 of the rotary handle 30 is again seen as is the pivot bolt 34. The mounting base 10 surrounds the rotary portion 30 and the mounting bolts 24A–D are seen, securing the stationary portion to the mounting base.

FIG. 5 shows the holes or slots 31A–F positioned above the end portions of the reed switches 22A, B and C. The switches 23A–C of the next, lower layer are omitted for clarity. However, since they may be in quadrature, it will be apparent that they will have a similar relationship to the magnets of the rotary, moveable portion when the magnets are in a corresponding orientation.

In operation, magnets are placed in certain of the holes, such as 31A–F of FIG. 3. These magnets must be strong enough to actuate reed-type switches such as 22A–C. The switches are oriented in such a manner that they may be actuated—or non-actuated—by the magnet being of one polarity or the other, or by being above one or the other of the ends of the reed-type switches. A typical orientation of the magnets and the switches is shown to accommodate one type of switching functions, but it will be obvious that other orientations and numbers of switches are possble.

The magnets can be oriented to actuate certain of the switches at certain angles of rotation of the moveable portion to perform the desired switching function. Not all of the holes such as 31 would be filled with magnets, or with magnets of the same polarity, or there may be no switching function. If two layers of the switches are being used, the magnets would be doubled where necessary to affect both layers.

Additional layers of switches could be accommodated by the use of additional or stronger magnets, and are within the scope of this invention, but the control of the switches will obviously become less positive as the layers are increased. Too many layers of switches would produce a more likelihood of errors, or interaction of the magnets, as their numbers are increased.

Once a given switching function is set-up within the device, it is obvious that a mark or label on the mounting base could be established to cooperate with an arrow or other indicator on the rotary moveable portion to establish any given setting.

An established position of the rotary portion, with respect to the base portion, may be established in a well-known manner by mechanical detent devices that would arrest the motion of and hold the rotary portion in a geven orientation.

An improved detent system is seen in my copending application, mentioned earlier. Here the detent is established by detent magnets in the rotary portion and in the base portion that will interact with each other to hold the device in any desired position or series of positions. These positions need not be uniform and, unlike most mechanical detent mechanisms, they can be interchanged at will by changing the positions or polarities of the detent magnets.

While six holes have been shown for the magnets, or combinations of magnets, for the switching function, to accommodate the particular orientation of the reed-type switches shown in the typical embodiment, it is obvious that other orientations and numbers of switches is possible, within the circular configuration, to provide other desirable switching functions. Such variations of the number of reed-type switching elements spaced about the stationary portion would have presumably required a corresponding variation in the number and placement of the control magnets in the rotary portion.

Since both the rotary portion, with its control magnets, and the stationary portion with its reed-type switches are interchangeable, it is obvious that an almost unlimited variation in the switching potential of this device is possible. While the switches, in their layers, may not be variable, other layers with alternate configurations of switches can be readily available to change any desired function. The control magnets, themselves, can be added to or taken out of any of the magnet holes—or their poles reversed—to change any specific switching function.

The mounting base 10 would presumably be of any nonferrous material, such as brass, aluminum, or plastic, that would not effect the magnetic fields of the control magnets that must penetrate the mounting base to actuate the switches. The mounting material of the switches in the stationary portions, too, would normally be of a non-ferrous substance that would not effect the magnetic fields of the control magnets. However, certain situations must be improved by the formation of a ferrous path through the various layers to focus the magnetic control fields towards the switches to be controlled.

The typical embodiment of FIGS. 1 to 5 is shown with a square mounting base and stationary portions. This permits only a quadrature degree of orientation of the layers of the switching devices. However, it will be obvious that the mountings of the layers of switching elements must preferably be in a hexagonal form to correspond to the configuration of the control magnets shown, or may be in any other geometric form that will provide the combinations of switches and control magnets necessary to provide the desired switching function.

It is to be understood that I do not desire to be limited to the exact details of construction shown and described, for obvious modifications will occur to a person skilled in the art.

What is claimed is:

1. A programable, compound reed-type switch comprising: a mounting base; a stationary portion secured beneath said mounting base; said stationary portion comprising at least two layers of reed-type switches positioned in at least two planes just below said mounting base; and a moveable portion rotatably secured above said mounting base, said moveable portion comprising at least one layer of magnets positioned in a plane just above said mounting base to pass over and actuate certain of said reed-type switches in the course of its rotation.

2. A programable, compound reed-type switch as in claim 1 having a first series of magnet holes equispaced about said moveable portion, equidistant from the axis of rotation of said moveable portion, and at least one magnet in at least one of said magnet holes of said first series to actuate certain of said reed-type switches in a prescribed sequence.

3. A programable, compound reed-type switch as in claim 2 wherein certain of said reed-type switches are positioned under certain of said magnet holes at given intervals of the rotation of said moveable portion.

4. A programable, compound reed-type switch as in claim 2 having 6 magnet holes in said first series positioned about said moveable portion equidistant from each other and equidistant from said axis of rotation of said moveable portion.

5. A programable, compound reed-type switch as in claim 2 wherein said reed-type switches are positioned with at least one of the actuatable extremities of each of said reed-type switches situated under a corresponding one of said magnet holes in at least one given position.

6. A programable, compound reed-type switch as in claim 2 having a second layer of magnets in certain of said first series of magnet holes to actuate certain reed-type switches in said second layer of reed-type switches in a given position of rotation of said moveable portion.

7. A programable, compound reed-type switch as in claim 2 having a detent means for holding said moveable portion in at least one given position with relation to said mounting base and said stationary portion.

* * * * *